US011026548B2

(12) United States Patent
Svantesson et al.

(10) Patent No.: US 11,026,548 B2
(45) Date of Patent: Jun. 8, 2021

(54) VACUUM CLEANER AND VACUUM CLEANER SYSTEM

(71) Applicant: Aktiebolaget Electrolux, Stockholm (SE)

(72) Inventors: Esbjörn Svantesson, Stockholm (SE); Henrik Holm, Stockholm (SE); Erik Dahlbeck, Stockholm (SE); Maeva Schaller, Stockholm (SE); Henrik Eriksson, Stockholm (SE); Jonas Kristiansson, Stockholm (SE); Jesper Hederos, Stockholm (SE)

(73) Assignee: Aktiebolaget Electrolux

( * ) Notice: Subject to any disclaimer, the term of this patent is extended or adjusted under 35 U.S.C. 154(b) by 327 days.

(21) Appl. No.: 16/095,525

(22) PCT Filed: Apr. 27, 2016

(86) PCT No.: PCT/EP2016/059339

§ 371 (c)(1),
(2) Date: Oct. 22, 2018

(87) PCT Pub. No.: WO2017/186280

PCT Pub. Date: Nov. 2, 2017

(65) Prior Publication Data

US 2019/0125147 A1 May 2, 2019

(51) Int. Cl.
*A47L 5/22* (2006.01)
*A47L 5/24* (2006.01)
(Continued)

(52) U.S. Cl.
CPC ..... *A47L 5/225* (2013.01); *A47L 5/24* (2013.01); *A47L 5/28* (2013.01); *A47L 9/0477* (2013.01);
(Continued)

(58) Field of Classification Search
CPC ... A47L 5/225; A47L 5/24; A47L 5/28; A47L 9/0477; A47L 9/244; A47L 9/2873; A47L 9/2884; A47L 9/322; A47L 9/327
See application file for complete search history.

(56) References Cited

U.S. PATENT DOCUMENTS 1,139,736 A 5/1915 Stabel
1,161,908 A 11/1915 Tice
(Continued)

FOREIGN PATENT DOCUMENTS

CN 2321380 Y 6/1999
CN 1266666 A 9/2000
(Continued)

OTHER PUBLICATIONS

International Search Report and Written Opinion for International Application No. PCT/EP2016/059339, dated Dec. 21, 2016—8 pages.
(Continued)

*Primary Examiner* — Dung Van Nguyen
(74) *Attorney, Agent, or Firm* — RatnerPrestia

(57) ABSTRACT

A vacuum cleaner having a profile arrangement with a profile having a first profile part and a second profile part. The second profile part is arranged to at least partly enclose the first profile part and the first profile part is slidable into the second profile part for adjustment of a length of the profile. The housing is moveably attached to the profile, such that the housing is moveable along at least a part of the length of the profile.

25 Claims, 6 Drawing Sheets

(51) Int. Cl.

| | |
|---|---|
| ***A47L 9/24*** | (2006.01) |
| ***A47L 9/28*** | (2006.01) |
| ***A47L 9/04*** | (2006.01) |
| ***A47L 9/32*** | (2006.01) |
| ***A47L 5/28*** | (2006.01) |

(52) U.S. Cl.

CPC ..... *A47L 9/244* (2013.01); *A47L 9/2873* (2013.01); *A47L 9/2884* (2013.01); *A47L 9/322* (2013.01); *A47L 9/327* (2013.01)

(56) References Cited

U.S. PATENT DOCUMENTS

| | | | |
|---|---|---|---|
| 1,355,553 | A | 10/1920 | Goughnour |
| 2,074,042 | A | 3/1937 | Bank |
| 2,203,088 | A | 6/1940 | Hansson |
| 2,530,886 | A | 11/1950 | Maisel |
| 2,660,457 | A | 11/1953 | Mallon |
| 2,867,833 | A | 1/1959 | Duff |
| 3,306,634 | A | 2/1967 | Groves et al. |
| 4,050,113 | A | 9/1977 | Wright et al. |
| 4,537,424 | A | 8/1985 | Maier et al. |
| 4,571,772 | A | 2/1986 | Dyson |
| 4,638,527 | A | 1/1987 | Fleischhauer |
| 4,653,137 | A | 3/1987 | Fleischhauer |
| 4,700,429 | A | 10/1987 | Martin et al. |
| 4,939,810 | A | 7/1990 | Ataka |
| 4,955,106 | A | 9/1990 | Stein et al. |
| 5,323,510 | A | 6/1994 | Redding et al. |
| 5,347,679 | A | 9/1994 | Saunders et al. |
| 5,584,095 | A | 12/1996 | Redding et al. |
| 5,584,436 | A | 12/1996 | Sepke |
| 5,794,305 | A | 8/1998 | Weger |
| 5,797,162 | A | 8/1998 | Vystrcil et al. |
| 6,055,703 | A | 5/2000 | Redding et al. |
| 6,065,183 | A | 5/2000 | Hammeken et al. |
| 6,108,861 | A | 8/2000 | Vystrcil et al. |
| 6,125,502 | A | 10/2000 | Hammeken et al. |
| 6,473,934 | B2 | 11/2002 | Lijzenga |
| 6,779,229 | B2 | 8/2004 | Lee et al. |
| 6,823,559 | B2 | 11/2004 | Kaffenberger et al. |
| 7,048,804 | B2 | 5/2006 | Kisela et al. |
| 7,222,393 | B2 | 5/2007 | Kaffenberger et al. |
| 7,251,856 | B2 | 8/2007 | Kaffenberger et al. |
| 7,356,876 | B2 | 4/2008 | Dant et al. |
| 7,353,564 | B2 | 8/2008 | Wertz |
| 7,503,098 | B2 | 3/2009 | Stein |
| 7,805,804 | B2 | 10/2010 | Loebig |
| 7,874,041 | B2 | 1/2011 | Buller et al. |
| 7,895,708 | B2 | 3/2011 | Proud et al. |
| 8,060,981 | B2 | 11/2011 | Basset et al. |
| 8,082,624 | B2 | 12/2011 | Myers |
| 8,141,203 | B2 | 3/2012 | Ashbee |
| 8,181,309 | B2 | 5/2012 | Mersmann et al. |
| 8,296,901 | B2 | 10/2012 | Rosenzweig et al. |
| 8,336,165 | B2 | 12/2012 | Finke et al. |
| 8,448,295 | B2 | 5/2013 | Vines et al. |
| 8,468,647 | B2 | 6/2013 | Lambourn |
| 8,468,649 | B2 | 6/2013 | Nielson et al. |
| 8,479,358 | B2 | 7/2013 | Conrad |
| 8,544,145 | B2 | 10/2013 | Arthey et al. |
| 8,595,897 | B2 | 12/2013 | Vines |
| 8,627,545 | B2 | 1/2014 | Streciwilk |
| 8,661,613 | B2 | 3/2014 | Marsh et al. |
| 8,667,643 | B2 | 3/2014 | Simonelli et al. |
| 8,713,754 | B2 | 5/2014 | Conrad |
| 8,789,238 | B2 | 7/2014 | Myers |
| 8,869,348 | B2 | 10/2014 | Conrad |
| 8,869,349 | B2 | 10/2014 | Henderson |
| 8,887,352 | B2 | 11/2014 | Muhlenkamp |
| 8,950,039 | B2 | 2/2015 | Conrad |
| D725,855 | S | 3/2015 | Burnham et al. |
| D730,001 | S | 5/2015 | Yun et al. |
| 9,215,960 | B2 | 12/2015 | Conrad |
| 9,282,862 | B2 | 3/2016 | Henderson et al. |
| 9,282,864 | B2 | 3/2016 | Guder et al. |
| 9,339,161 | B2 | 3/2016 | McLuckie et al. |
| D759,919 | S | 6/2016 | Smith et al. |
| D770,106 | S | 10/2016 | Johnson et al. |
| D772,510 | S | 11/2016 | Palladino |
| D778,015 | S | 1/2017 | Miller et al. |
| 9,554,680 | B2 | 1/2017 | Elsdon et al. |
| D783,912 | S | 4/2017 | Shin |
| D784,636 | S | 4/2017 | Canas et al. |
| 9,668,631 | B2 | 6/2017 | Conrad |
| D791,421 | S | 7/2017 | Wu et al. |
| 9,901,227 | B2 | 2/2018 | Conrad |
| 9,907,446 | B2 | 3/2018 | Toole et al. |
| 9,943,199 | B2 | 4/2018 | Grey et al. |
| 9,955,831 | B2 | 5/2018 | Bilger |
| 9,962,050 | B2 | 5/2018 | Conrad et al. |
| 10,016,107 | B2 | 7/2018 | Thorne |
| 10,080,471 | B2 | 9/2018 | Reimer et al. |
| D836,863 | S | 12/2018 | Theising et al. |
| 10,149,585 | B2 | 12/2018 | Conrad |
| D837,469 | S | 1/2019 | Johnson et al. |
| D844,914 | S | 4/2019 | Houghton |
| 2002/0042969 | A1 | 4/2002 | Nagai et al. |
| 2006/0000053 | A1 | 1/2006 | Lim |
| 2006/0137134 | A1 | 6/2006 | Dilger et al. |
| 2008/0295282 | A1 | 12/2008 | Olsson et al. |
| 2010/0175217 | A1 | 7/2010 | Conrad |
| 2011/0219567 | A1 | 9/2011 | Conrad |
| 2012/0000030 | A1 | 1/2012 | Conrad |
| 2014/0033469 | A1 | 2/2014 | Toole et al. |
| 2014/0033470 | A1 | 2/2014 | Codling et al. |
| 2014/0033472 | A1 | 2/2014 | Dyson |
| 2014/0331445 | A1 | 11/2014 | Thorne et al. |
| 2014/0366309 | A1 | 12/2014 | Conrad |
| 2014/0366314 | A1 | 12/2014 | Conrad |
| 2015/0040344 | A1 | 2/2015 | Henderson |
| 2015/0135470 | A1* | 5/2015 | Mantyla ..... A47L 9/2873 15/301 |
| 2016/0157687 | A1 | 6/2016 | Perez et al. |
| 2016/0157690 | A1 | 6/2016 | Streciwilk et al. |

FOREIGN PATENT DOCUMENTS

| | | | |
|---|---|---|---|
| CN | 101813112 | A | 8/2010 |
| DE | 19630286 | A1 | 1/1998 |
| DE | 202004000425 | U1 | 4/2004 |
| DE | 202005013078 | U1 | 11/2005 |
| DE | 202006011001 | U1 | 11/2006 |
| DE | 102009059290 | A1 | 6/2011 |
| EP | 0853917 | A1 | 7/1998 |
| EP | 1969988 | A2 | 9/2008 |
| GB | 1151990 | | 5/1969 |
| GB | 2447995 | A | 10/2008 |
| GB | 2554937 | A | 4/2018 |
| JP | 5261173 | U | 5/1977 |
| JP | 6383145 | U | 6/1988 |
| JP | 63125947 | U | 8/1988 |
| JP | 11309099 | A | 11/1999 |
| JP | 2003061883 | A | 3/2003 |
| JP | 2014124443 | A | 7/2014 |
| SE | 104383 | C1 | 4/1942 |
| SE | 334712 | B | 5/1971 |
| WO | 8607247 | A1 | 12/1986 |
| WO | 9740733 | A1 | 11/1997 |
| WO | 9911170 | A1 | 3/1999 |
| WO | 2004103144 | A1 | 12/2004 |
| WO | 2015020673 | A1 | 2/2015 |
| WO | 2016141960 | A1 | 9/2016 |

OTHER PUBLICATIONS

International Preliminary Report on Patentability for International Application No. PCT/EP2017/083132, dated Jun. 16, 2020, 7 pages.

International Search Report and Written Opinion for International Application PCT/EP2017/083132, dated Jun. 27, 2018, 10 pages.

Non Final Office Action for U.S. Appl. No. 29/634,734, dated Oct. 11, 2019, 6 pages.

(56) References Cited

OTHER PUBLICATIONS

Japanese Notice of Reasons for Refusal for Japanese Application No. 2018-546841, dated Apr. 2, 2020 with translation, 7 pages.
Japanese Notice of Reasons for Refusal for Japanese Application No. 2018-546841, dated Nov. 5, 2020, 2 pages.

* cited by examiner

VACUUM CLEANER AND VACUUM CLEANER SYSTEM

TECHNICAL FIELD

Embodiments herein relate to a vacuum cleaner. More particularly, embodiments herein relate to an upright/stick type vacuum cleaner and/or a handheld vacuum cleaner. Embodiments herein further relate to a vacuum cleaner system comprising a vacuum cleaner and a docking station.

BACKGROUND

Different kinds of stick type vacuum cleaners are known. This type of vacuum cleaner generally have an elongated body with a nozzle in one end and a handle in the other end. A housing with a fan and filter may be attached to the elongated body and may extend substantially in parallel thereto. Such housing may comprise a fan and motor, a dust collector, a filter and other necessary parts.

Handheld vacuum cleaners allow a user to remove dust and debris in a relatively easy and efficient manner and may be operated with a single hand grip.

In some stick type vacuum cleaners the housing is detachable from the elongated body and may be used independently as a handheld vacuum cleaner separate from the elongated body. This may be practical e.g. for sucking up crumbs from tables and similar. This also allow a user to reach surfaces where a nozzle of the body would not fit. In EP1969988 an example of such a vacuum cleaner is disclosed.

A drawback with many upright/stick type vacuum cleaners is that it is difficult to vacuum clean under beds, sofas and the like, since the housing may restrict how far the nozzle may reach. In other words, the housing may hit the bed/sofa when a dimension of the housing is larger than the height between the bed/sofa and the floor to be cleaned.

Further, it may be a challenge to efficiently use the vacuum cleaner on surfaces above a certain height, such as walls, shelfs and ceilings, since the design of the handheld vacuum cleaner is generally optimized for floor-cleaning.

In GB1151990 some of these problems or disadvantages are addressed. A housing of the vacuum cleaner in GB1151990 may be moved between different positions. Hereby a user may access surfaces under low furniture's and similar. The vacuum cleaner disclosed in GB1151990 works well in some applications, but there remains a need improvements with regards to efficiency, flexibility and ergonomics.

SUMMARY

An object is to provide a more efficient vacuum cleaner.

According to an embodiment, the object is achieved by a vacuum cleaner comprising; a housing comprising a motor fan unit for generating an airflow, a housing air outlet and a housing air inlet, and a profile arrangement comprising a first profile end for attachment of a nozzle, a profile handle end for attachment of a handle and a profile extending between the first profile end and the profile handle end, and an airflow channel extending from the first profile end to the housing air outlet via the housing air inlet, for allowing an airflow from the first profile end to the housing air outlet. The profile arrangement comprises a first profile part and a second profile part, the second profile part is arranged to at least partly enclose the first profile part and the first profile part is slidable into the second profile part for adjustment of a length of the profile and that the housing is arranged to be moveably attached to the profile, such that the housing is moveable along at least a part of the length of the profile.

Since the first profile part is slidable or retractable into the second profile part and the housing is arranged to be moveably attached to the profile such that the housing is moveable along at least a part of the length of the profile a very flexible vacuum cleaner is achieved. A user may extend the profile when necessary, such that he/she may use the vacuum cleaner in a standing position, and may retract the profile, e.g. when using the vacuum cleaner in a staircase or similar. Further, he/she may move the housing to a position relatively near the nozzle when vacuum cleaning a floor and may move the housing to a position closer to the grip portion e.g. when he/she is vacuum cleaning walls, ceilings etc. A user may thus change both the length of the profile and the gravity point of the vacuum cleaner. Hereby the vacuum cleaner enables efficient, flexible and ergonomic vacuum cleaning. This further allows the vacuum cleaner to have relatively more weight if necessary. This has proven to be very useful when the vacuum cleaner is equipped with a powerful motor and a battery with some weight.

According to some embodiments the profile comprises at least one opening, the at least one opening being a slit shaped opening, having a first slit opening section in the first profile part and a second slit opening section in the second profile part. The housing is arranged to be movably attached to the profile at different positions of the first and/or the second profile part and an airflow from the nozzle/first profile end can enter the housing via the first slit opening section or the second slit opening section.

According to some embodiments the profile comprises opening cover means, arranged to allow the airflow channel to a section of the opening where the housing air inlet is positioned. According to some embodiments the opening cover means are arranged to close off the remaining sections of the opening. This enables an efficient flow and a strong suction force from the first profile end to the housing. The opening covering means also prevent smaller objects from getting stuck in the opening and may prevent a user from jamming his/her fingers in the opening when moving the housing along the length of the profile.

According to some embodiments the opening cover means is at least one of; a flexible cover strip, one or more elastic sealing elements, one or more lids and a zipper arrangement. Hereby efficient covering of the opening is achieved.

According to some embodiments the vacuum cleaner comprises a flexible hose with a first end in the first profile end and a second end operatively connected to the housing air inlet. A flexible hose is a reliable and efficient solution for connecting the first profile end with the housing air inlet. The flexible hose also provides for an efficient and obstacle-free airflow between the first profile end and the housing air inlet.

According to some embodiments the flexible hose at least partly is enclosed within the profile, and the second end is operatively connected to the housing air inlet via the opening of the profile. The flexible hose is then well-protected by the profile.

According to some embodiments the first profile part comprises a first rail, the second profile part comprises a second rail and the housing comprises a housing base which is arranged to be displaced along the first rail and/or the second rail. Hereby the housing easily and reliably is displaceable between different positions along the profile. The housing may be permanently or releasable attached to the housing base. According to some embodiments the housing air inlet is arranged in the housing base and the second end of the flexible hose is arranged to be attached to the housing base.

According to some embodiments the profile comprises at least one opening which comprises two or more distinct openings along the length of the profile. Hereby the housing easily may be moved between different distinct positions along the profile. According to some embodiments the housing is attachable to the profile in positions along the length of the profile for which the housing air inlet is substantially aligned to one distinct opening of the two or more distinct openings and according to some embodiments one or more distinct openings which is/are not substantially aligned to the air inlet is/are closed off by the opening covering means. This enables an efficient flow and a strong suction force from the first profile end to the housing.

According to some embodiments the vacuum cleaner comprises a handle, attached to the profile arrangement, preferably pivotally attached to the profile handle end. The handle allows a user to adjust a handle positions in accordance to his/her preferences. The handle also may be used to extend or shorten a length of the vacuum cleaner.

According to some embodiments the handle comprises a control arrangement for control of at least one of a fan effect and a nozzle function. Hereby a flow rate of air may be adjusted. A user may also efficiently control one or more nozzle functions, such as nozzle lights, a brush roller or the like via the control arrangement.

According to some embodiments the vacuum cleaner comprises a nozzle with a nozzle air inlet, attachable to the first profile end. A nozzle may be useful in many applications, such as during vacuum cleaning of a floor.

According to some embodiments the vacuum cleaner comprises a first side which is arranged to face upwards or oblique upwards when the vacuum cleaner is positioned in an operating position and a second side, arranged to face downwards or oblique downwards when the vacuum cleaner is positioned in an operating position, and in that the housing is attached to the first side. Hereby vacuum cleaning under sofas, beds etc. is facilitated.

According to some embodiments the vacuum cleaner comprises a chargeable battery for powering of e.g. the motor fan unit. A battery may be a substantial part of a weight of the vacuum cleaner. Embodiments herein has proven to efficiently "compensate" for this weight since a user may both select a suitable length and select where the point of gravity should be located along the profile.

An object herein is also to provide a more efficient vacuum cleaner system. According to an embodiment, the object is achieved by a vacuum cleaner system comprising a docking station and a vacuum cleaner according to embodiments herein, said docking station being capable to charge the battery of the vacuum cleaner. Hereby an efficient, flexible and ergonomic vacuum cleaner system is achieved.

BRIEF DESCRIPTION OF THE DRAWINGS

The various aspects of embodiments herein, including its particular features and advantages, will be readily understood from the following detailed description and the accompanying drawings, in which.

DETAILED DESCRIPTION

Embodiments herein will now be described more fully with reference to the accompanying drawings, in which embodiments are shown. Well-known functions or constructions will not necessarily be described in detail for brevity and/or clarity.

Figure 1:
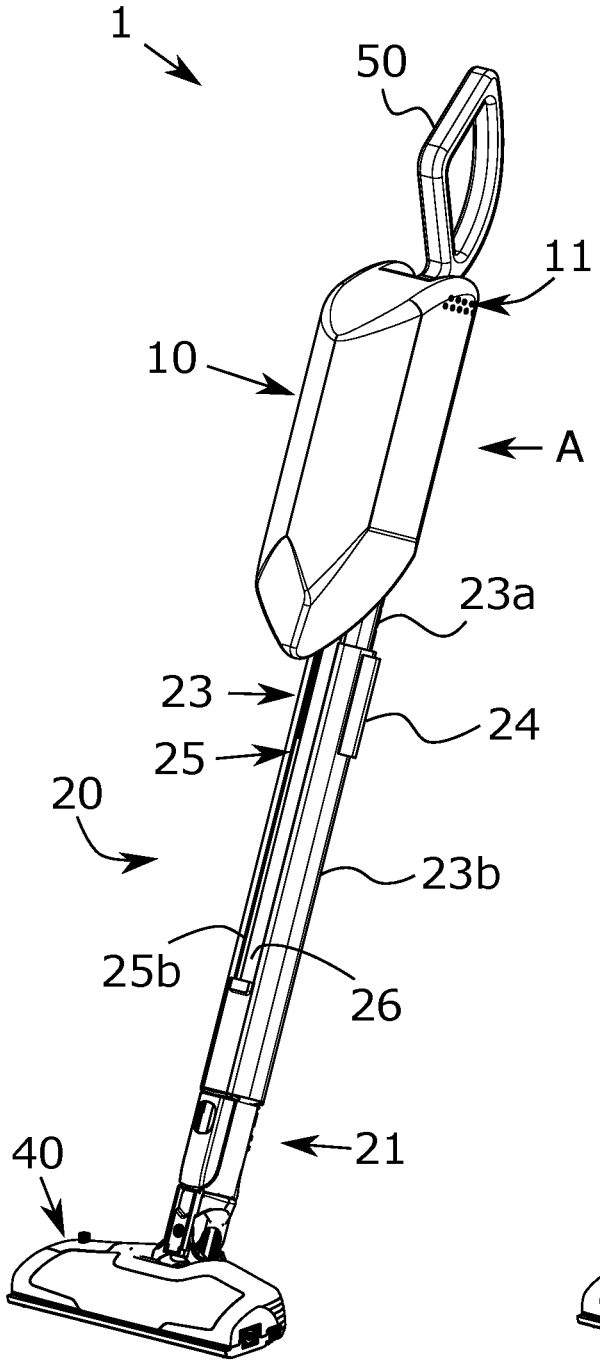
FIG. 1 illustrates a perspective view of a vacuum cleaner according to some embodiments with the housing in a first position.
Figure 2:
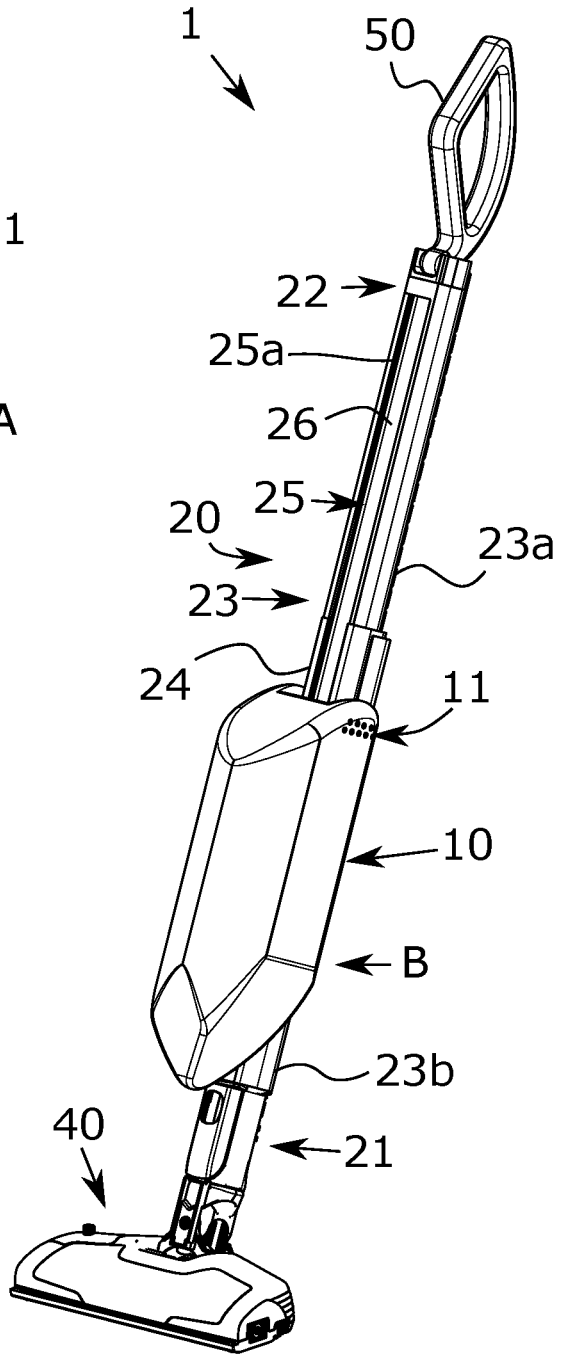
FIG. 2 illustrates the FIG. 1 vacuum cleaner with the housing in a second position.

FIG. 1 and FIG. 2 illustrate a vacuum cleaner 1 according to some embodiments. In FIG. 1 and FIG. 2 the vacuum cleaner 1 is illustrated in perspective view.

Figure 9:
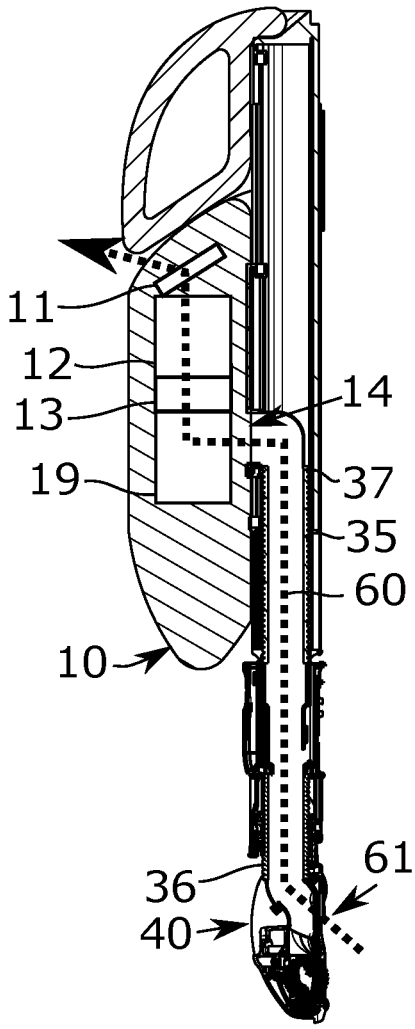
FIG. 9 illustrates a cross section of the FIG. 3 vacuum cleaner.
Figure 10:
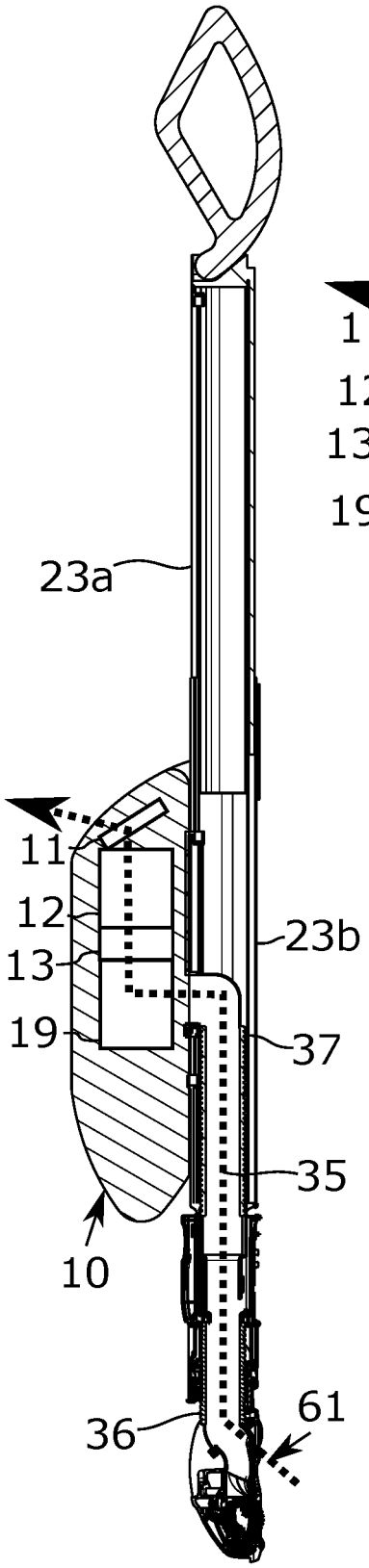
FIG. 10 illustrates a cross section of the FIG. 4 vacuum cleaner.
Figure 11:
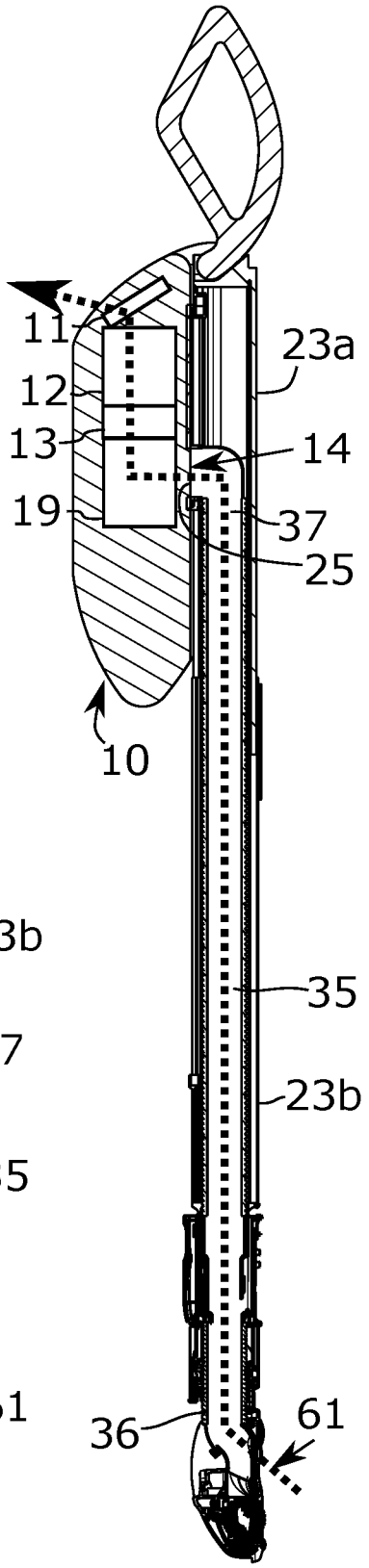
FIG. 11 illustrates a cross section of the FIG. 5 vacuum cleaner.

The vacuum cleaner 1 comprises a housing 10. The housing 10 may be made as a hollow body or structure for housing some parts of the vacuum cleaner 1. The housing 10 may comprise a motor fan unit for generating an airflow. A schematic airflow and a schematic motor fan unit are illustrated in FIGS. 9-11. The housing 10 also comprises a housing air outlet 11 and a housing air inlet, also illustrated in FIGS. 9-11.

The vacuum cleaner 1 further comprises a profile arrangement 20. The profile arrangement 20 comprises a first profile end 21 a profile grip portion 22 and a profile 23 extending between the first profile end 21 and the profile grip portion 22. The profile arrangement 20 comprises at least one opening 25 for allowing an airflow from the first profile end 21 to the housing air inlet. The profile arrangement 20 may also be referred to as an open profile arrangement, an elongated profile arrangement or the like. The profile 23 may also be referred to as an open profile, an elongated profile or the like. The opening 25 can for example be a slit shaped opening, having a first slit opening section 25*a* in the first profile part 23*a* and a second slit opening section 25*b* in the second profile part 23*b*. In other embodiments, illustrated in conjunction with FIG. 16, the at least one opening 25 comprises two or more distinct openings 25' along the length of the profile 23. As illustrated in FIGS. 1 and 2 the opening 25 may be radially arranged or directed, in contrast to any end orifices of the profile 23.

The profile arrangement 20 comprises the first profile part 23*a* and the second profile part 23*b*. The second profile part 23*b* is arranged to at least partly enclose the first profile part 23*a*. In the embodiment illustrated in FIGS. 1 and 2 the second profile part 23*b* is illustrated closest to a nozzle 40 of the vacuum cleaner 1. In other embodiments the first profile part 23*a* is closest to the nozzle 40. In other words, a profile part with a larger dimension, into which the other profile part may be slid, can selectively be arranged at an upper or lower position. The first profile part 23*a* is slidable or retractable into the second profile part 23*b* for adjustment of a length of the profile 23. The first profile part 23*a* and the second profile part 23*b* together form a telescopic profile 23. The profile arrangement 20 may comprise a lock 24 or similar for locking the first profile part 23*a* and the second profile part 23*b* relatively each other.

In the embodiments illustrated in FIGS. 1 and 2 also a handle 50 is attached to the profile grip portion 22.

Figure 16:
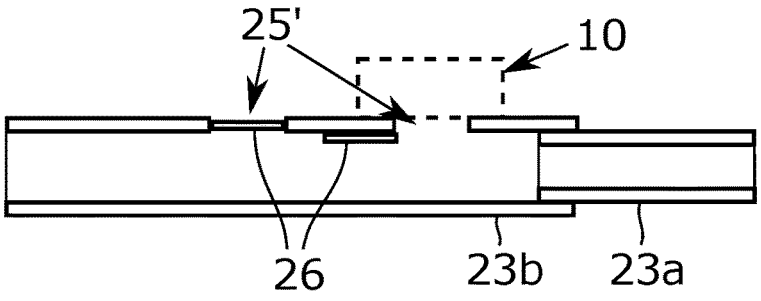

The vacuum cleaner illustrated in FIGS. 1 and 2 comprises opening cover means 26. The opening cover means 26 are arranged to allow an airflow to a section of the opening 25 where the housing 10 with its air inlet is positioned and to close off the remaining sections of the opening 25. The opening cover means 26 can comprise and close off sections of the opening 25. Alternatively the opening cover means 26 comprises a flexible cover strip. Such flexible cover strip may be designed with the same working principle as an extendable/retractable measure tape and may comprise one or two parts. The opening cover means 26 may in some embodiments comprise of one or more elastic sealing elements for selectively closing off the opening 25. The opening cover means 26 may also comprise a zipper arrangement or the like for selectively closing off the opening. The opening cover means 26 may also/alternatively comprise one or more lids, as illustrated in FIG. 16.

The housing 10 is arranged to be attached to the profile 23 at different positions of the first profile part 23*a* and/or the second profile part 23*b* along the length of the profile 23. In FIG. 1 the housing 10 is arranged in a first position A and in FIG. 2 the housing is arranged in a second position B. Since the first position is most far from the nozzle it may sometimes be referred to as an upper position and the second position may sometimes be referred to as a lower position when the vacuum cleaner is arranged in a standup position.

It is understood that the housing 10 can be arranged in a number of different positions along the length of the profile 23. The first position A and the second position B may serve as examples of housing positions. In some embodiments the housing 10 may be arranged in e.g. 2-6 distinct positions along the length of the profile 23. In some embodiments the housing 10 may be arranged to be freely slidable and to be attachable at any position along the length of the profile 23. The housing may be fixed in a selected position by a latch of any kind and released when the latch is opened.

Figure 3:
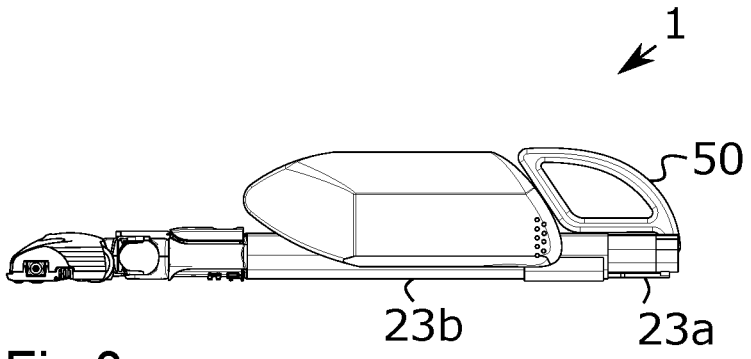
FIG. 3 illustrates a side view of the vacuum cleaner according to some embodiments when retracted.

In FIG. 3 the vacuum cleaner 1 is retracted and the first profile part 23*a* is to a high extent enclosed by the second profile part 23*b*. The handle 50 is in a folded position. This vacuum cleaner set-up may be suitable e.g. for vacuum cleaning of staircases.

Figure 4:
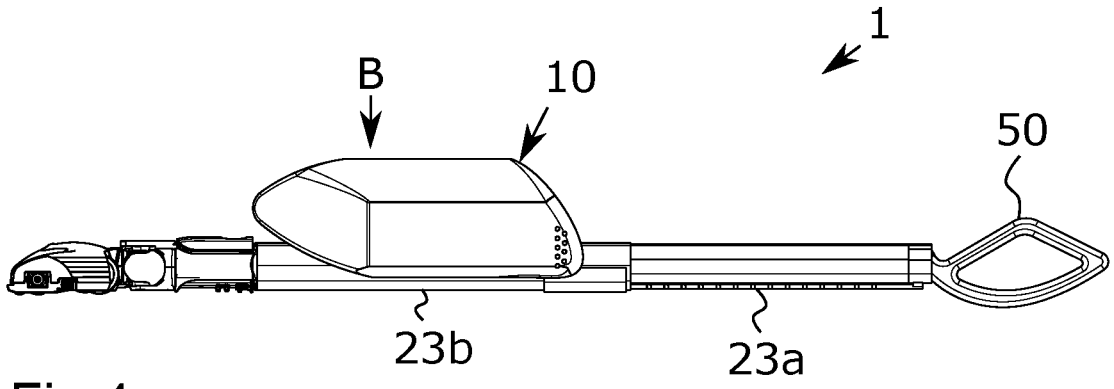
FIG. 4 illustrates the FIG. 3. vacuum cleaner when extracted and with the housing in the second position.

In FIG. 4 the vacuum cleaner 1 is extracted and only a small part of the first profile part 23*a* is enclosed by the second profile part 23*b*. The handle 50 is in an open position. The housing 10 is in a lower or second position B. This vacuum cleaner set-up may be suitable e.g. during vacuum cleaning of floors when a relatively low point of gravity may be preferred.

Figure 5:
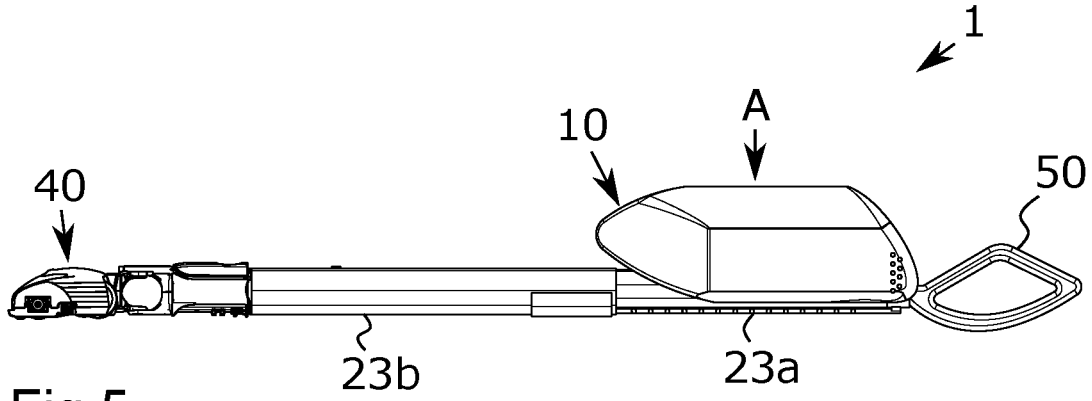
FIG. 5 illustrates the FIG. 4 vacuum cleaner with the housing in the first position.

In FIG. 5 the vacuum cleaner 1 is extracted and only a small part of the first profile part 23*a* is enclosed by the second profile part 23*b*, The handle 50 is in an open position. The housing 10 is in an upper or first position A. This vacuum cleaner set-up may be suitable e.g. during vacuum cleaning in situations where the nozzle 40 is higher up than the housing 10, such as when walls, high shelfs or ceilings are vacuum cleaned. Since the housing 10 is in the second position B, it will be relatively low when the vacuum cleaner has the nozzle 40 upwards, Thus, a relatively low point of gravity is achieved also during these vacuum cleaning operations. Further, this vacuum cleaner set-up may be advantageous for vacuum cleaning under low furniture's such as beds, sofas and the like. Since the housing 10 is in the first position A the nozzle 40 may reach far under a bed without being hindered by the housing 10.

Figure 6:
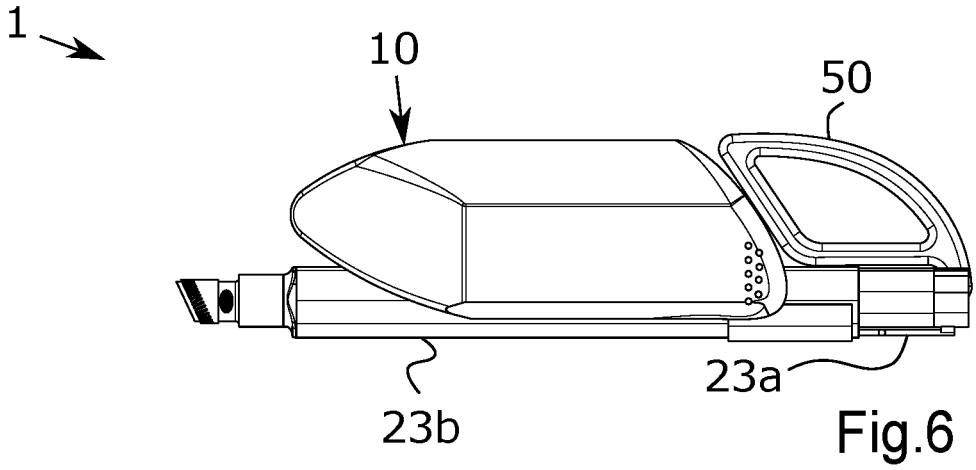
FIG. 6 illustrates a vacuum cleaner according to some embodiments when retracted.

FIG. 6 illustrates the vacuum cleaner 1 with only a small type of nozzle attached. The vacuum cleaner 1 is retracted and the first profile part 23*a* is to a high extent enclosed by the second profile part 23*b*. The handle 50 is in a folded position. This vacuum cleaner set-up may be suitable e.g. for vacuum cleaning of tables, shelfs and similar.

Figure 7:
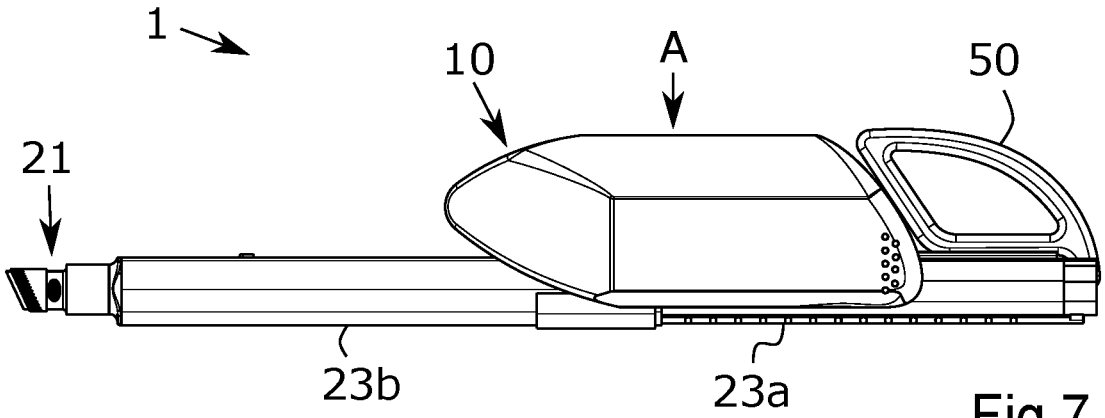
FIG. 7 illustrates a vacuum cleaner according to some embodiments.

In FIG. 7 the vacuum cleaner 1 is extracted and only a small part of the first profile part 23*a* is enclosed by the second profile part 23*b*. The handle 50 is in a closed position. The housing 10 is in the first position A. This vacuum cleaner set-up may be suitable e.g. during vacuum cleaning in situations where the first profile end 21 is higher up than the housing 10, such as when walls, high shelfs or ceilings are vacuum cleaned. Since the housing 10 is in the first position A, it will be relatively low when the vacuum cleaner has the first profile end 21 upwards, Thus, a relatively low point of gravity is achieved also during these vacuum cleaning operations.

Figure 8:
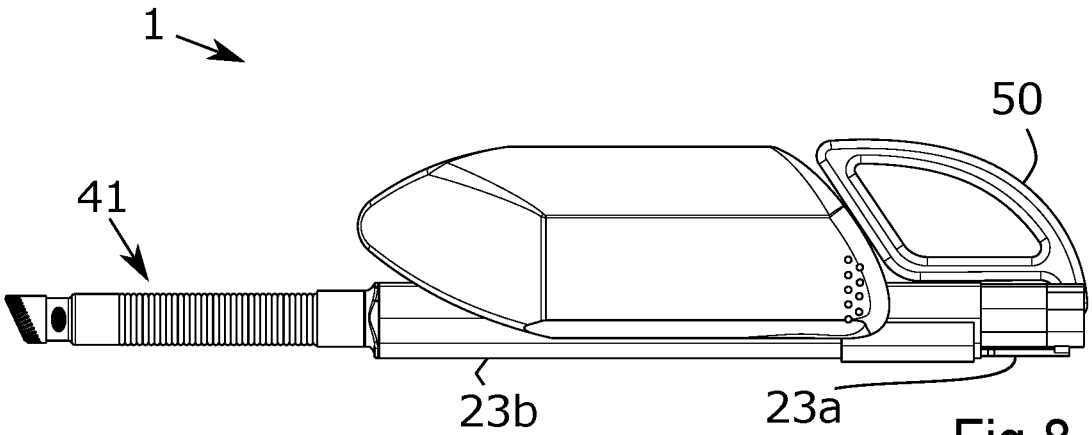
FIG. 8 illustrates a vacuum cleaner according to some other embodiments.

FIG. 8 illustrates the vacuum cleaner 1 with a combined nozzle and a flexible tube 41 attached. The vacuum cleaner 1 is retracted and the first profile part 23*a* is to a high extent enclosed by the second profile part 23*b*. The handle 50 is in a folded position. This vacuum cleaner set-up may be suitable e.g. for vacuum cleaning of tables, shelfs and similar.

In FIG. 9, FIG. 10 and FIG. 11 schematic cross sections of the vacuum cleaner 1 are illustrated. The housing 10 may comprise a motor fan unit 12, one or more filters 13 and a housing air inlet 14. The housing 10 may also comprise a bag, dust separation chamber or dust collector 19. The motor fan unit is capable of building up an under-pressure, thereby causing an airflow 60 to flow from an air inlet 61 at the nozzle 40 to the housing air outlet 11 via the housing air inlet 14. FIG. 10 is a schematic cross section of the vacuum cleaner set-up illustrated in FIG. 4 with the housing 10, the first profile part 23*a* and the second profile part 23*b*. FIG. 11 is a schematic cross section of the vacuum cleaner set-up illustrated in FIG. 5 with the housing 10, the first profile part 23*a* and the second profile part 23*b*.

In the embodiments illustrated in FIGS. 9-11 a flexible hose 35 is illustrated. The flexible hose 35 can be arranged within the profile with a first end 36 in the first profile end and a second end 37 operatively connected to the opening 25 of the profile 23 and to the housing air inlet 14.

Figure 12:
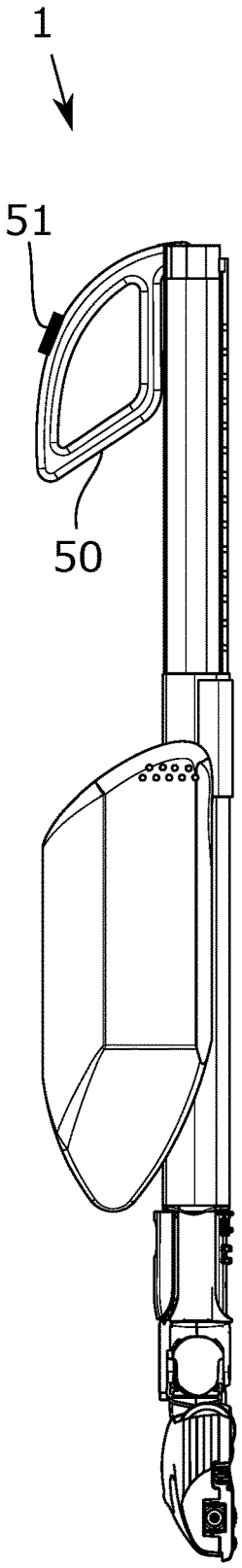
FIG. 12 illustrates a vacuum cleaner according to some other embodiments with a handle in a folded position.
Figure 13:
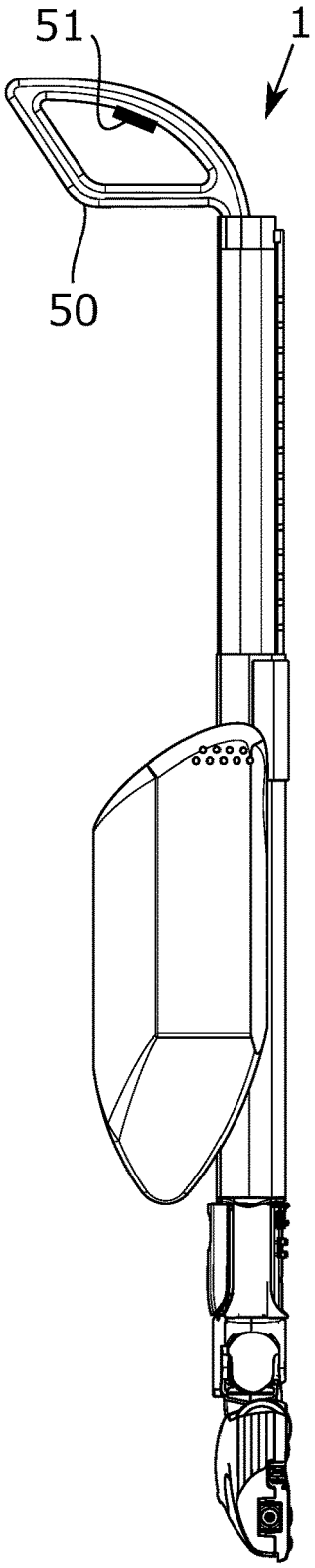
FIG. 13 illustrates a vacuum cleaner according to some other embodiments with the handle in a semi-folded position.

FIG. 12 is a side view of the vacuum cleaner 1 with the handle 50 in a folded position. FIG. 13 is a side view of the vacuum cleaner 1 with the handle 50 in a semi-folded position and in FIG. 14 the vacuum cleaner 1 has the handle 50 in the open position. The handle 50 may optionally comprise a control arrangement 51 for control of at least one of a fan effect, a nozzle function or any other vacuum cleaner function which may need to be adjustable.

Figure 14:
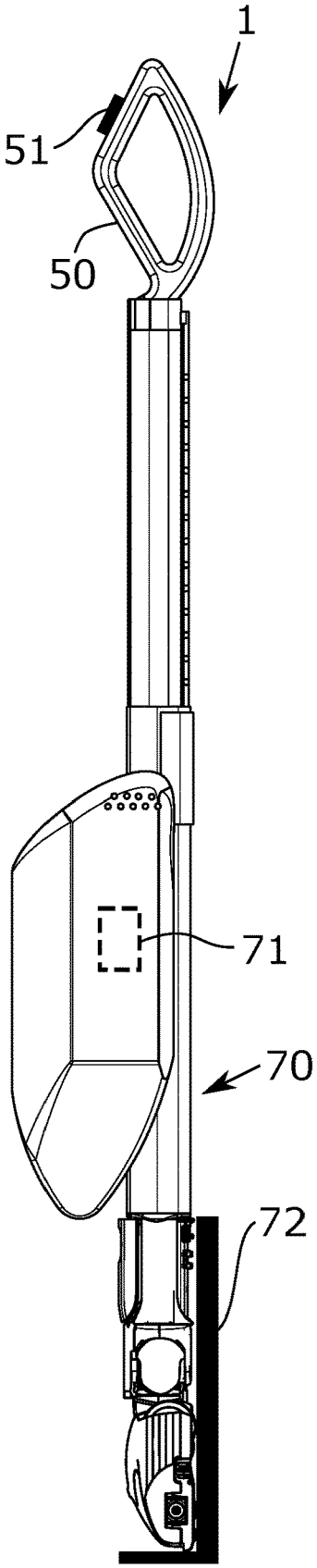
FIG. 14 illustrates a vacuum cleaner system and a vacuum cleaner according to some other embodiments with the handle in an open position.

In FIG. 14 a vacuum cleaner system 70 with a chargeable battery 71 and a docking station 72 are illustrated. The docking station 72 is capable to charge the battery 71 of the vacuum cleaner. In some embodiment the vacuum cleaner 1 may be powered via an electric cable instead of a battery.

Figure 15:
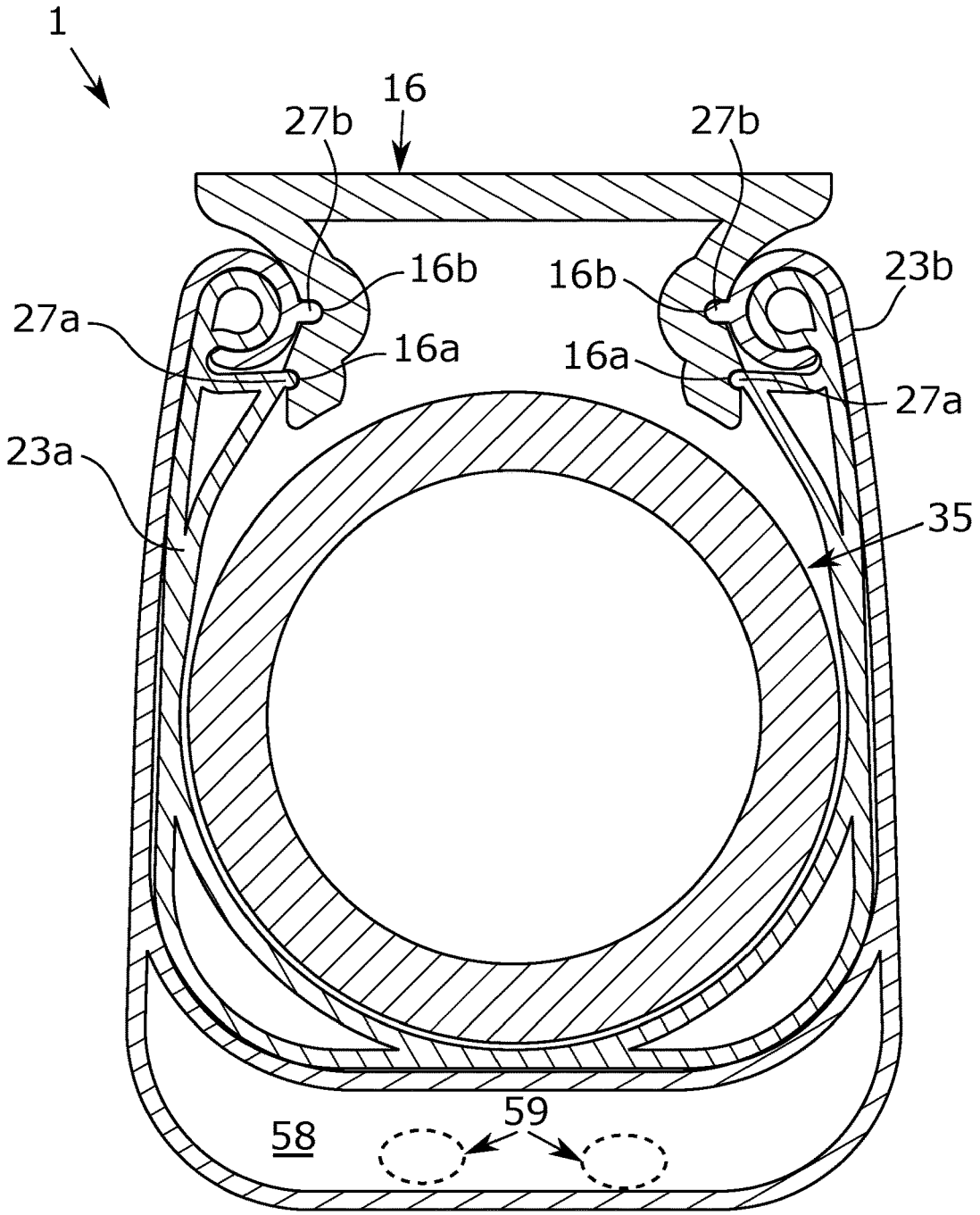
FIG. 15 illustrates a cross-section of the vacuum cleaner, and FIG. 16 schematically illustrates a vacuum cleaner according to some embodiments.

FIG. 15 illustrates a cross-sectional view of the vacuum cleaner 1 according to some embodiments. In the embodiment depicted in FIG. 15 the vacuum cleaner 1 comprises the first profile part 23*a*, the second profile part 23*b* and the flexible hose 35. The first profile part 23*a* comprises a first rail 27*a*. The second profile part 23*b* comprises a second rail 27*b*. The housing comprises a housing base 16 which is arranged to be displaced along the first rail 27*a* and/or the second rail 27*b*. The housing base 16 may comprise grooves 16*a* arranged to co-operate with the first rail 27*a* and second grooves 16*b* arranged to co-operate with the second rail 27*b*. Hereby the housing base 16 easily may be slid/displaced along the profile. The housing air inlet (denominated 14 in FIGS. 9-11) may be arranged in the housing base 16. The second end of the flexible hose (denominated 37 in FIGS. 9-11) may be arranged to be attached to the housing base 16.

In some embodiments the housing base 16 comprises one or more brackets or sleeves which partly or fully may encloses the profile 23, The housing base 16 may then be slid along a length of the profile 23 mainly co-operating with exterior surfaces of the first 23*a* and/or second 23*b* profile parts. A first sleeve part may be arranged to be fit around the first profile part 23*a* and a second sleeve part may be arranged to be fitted around the second profile part 23*b*. Such embodiments may be designed with rails or may be designed without any rails.

In FIG. 15 electrical cables 59 are illustrated. Such cables may be arranged within an interstice 58 of a profile part. Such cables 59 may connect a control arrangement at a handle with other parts, such as the nozzle, fan and/or motor. In some embodiments sliding contacts are arranged within the interstice 58.

In FIG. 16 is illustrated an embodiment in which the at least one opening comprises two distinct openings 25' along the length of the first profile part 23*a* and the second profile part 23*b*. Covering means 26 in form of lids may be arranged to allow airflow to the housing 10 and to block openings 25' at other positions. The lids may e.g. be biased into closed positions and forced to be opened by the housing 10.

The housing, profile arrangement, nozzle and handle may, at least partly, be made of plastics, metal or any other suitable material.

The invention claimed is:

1. A vacuum cleaner comprising;

a housing comprising a motor fan unit configured to generate an airflow, a housing air outlet and a housing air inlet;

a profile arrangement comprising a first profile end configured to attach to a nozzle, a profile handle end configured to attach to a handle and a profile extending between the first profile end and the profile handle end; and an airflow channel extending from the first profile end to the housing air outlet via the housing air inlet, configured to convey an airflow from the first profile end to the housing air outlet;

wherein:

the profile arrangement comprises a first profile part and a second profile part, the second profile part is arranged to at least partly enclose the first profile part and the first profile part is slidable into the second profile part for adjustment of a length of the profile from the first profile end to the profile handle end;

the housing is moveably attached to the profile arrangement, such that the housing is moveable along at least a part of the length of the profile arrangement;

the airflow channel comprises a flexible hose having a first end in the first profile end and a second end operatively connected to the housing air inlet; and the flexible hose at least partly is enclosed within the profile arrangement, and the second end is operatively connected to the housing air inlet via an elongated opening through the profile arrangement.

2. The vacuum cleaner according to claim 1, wherein the elongated opening through the profile arrangement comprises a first opening section in the first profile part and a second opening section in the second profile part.

3. The vacuum cleaner according to claim 1, wherein the housing air inlet is positioned adjacent the elongated opening, and a portion of the elongated opening immediately adjacent the housing air inlet permits the airflow to pass therethrough from the profile arrangement to the housing air inlet.

4. The vacuum cleaner according to claim 3, further comprising a cover configured close off a portion of the elongated opening that is not immediately adjacent the housing air inlet.

5. The vacuum cleaner according to claim 4 wherein the cover comprises at least one of: a flexible cover strip, one or more elastic sealing elements, one or more lids; or a zipper arrangement.

6. The vacuum cleaner according to claim 1, wherein the first profile part comprises a first rail, the second profile part comprises a second rail and the housing comprises a housing base which is arranged to be displaced along the first rail and/or the second rail.

7. The vacuum cleaner according to claim 6, wherein the housing air inlet is in the housing base and wherein the second end of the flexible hose is attached to the housing base.

8. The vacuum cleaner according to claim 1 wherein the profile arrangement comprises two or more distinct openings along the length of the profile arrangement.

9. The vacuum cleaner according to claim 8 wherein the housing is attachable to the profile arrangement in two or more positions along the length of the profile arrangement at which the housing air inlet is in fluid communication with one distinct opening of the two or more distinct openings.

10. The vacuum cleaner according to claim 9, further comprising a cover, and wherein one or more distinct openings which is/are not in fluid communication with the air inlet is/are closed off by the cover.

11. The vacuum cleaner according to claim 1, wherein the vacuum cleaner comprises a handle, attached to the profile arrangement at the profile handle end.

12. The vacuum cleaner according to claim 11, wherein the handle comprises a control arrangement configured to control at least one of a fan effect and a nozzle function.

13. The vacuum cleaner according to claim 1, wherein the vacuum cleaner comprises a nozzle with a nozzle air inlet, the nozzle being removably attachable to the first profile end.

14. The vacuum cleaner of claim 13, wherein the first end of the flexible hose is extendable from the first profile end when the nozzle is removed from the first profile end.

15. The vacuum cleaner according to claim 1, wherein the vacuum cleaner comprises a first side which is arranged to face upwards or oblique upwards when the vacuum cleaner is positioned in an operating position and a second side, arranged to face downwards or oblique downwards when the vacuum cleaner is positioned in an operating position, and the housing is attached to the first side.

16. The vacuum cleaner according to claim 1, wherein the vacuum cleaner comprises a chargeable battery configured to power the motor fan unit.

17. A vacuum cleaner system comprising a docking station and a vacuum cleaner according to claim 16, the docking station being configured to charge the battery of the vacuum cleaner.

18. The vacuum cleaner according to claim 1, wherein the flexible hose is movable to a configuration in which the flexible hose is enclosed entirely within the profile arrangement.

19. A vacuum cleaner comprising;

a housing comprising a motor fan unit configured to generate an airflow, a housing air outlet and a housing air inlet;

a profile arrangement comprising a first profile end configured to attach to a nozzle, a profile handle end configured to attach to a handle and a profile extending between the first profile end and the profile handle end; and an airflow channel extending from the first profile end to the housing air outlet via the housing air inlet, configured to convey an airflow from the first profile end to the housing air outlet;

wherein:

the profile arrangement comprises a first profile part and a second profile part, the second profile part is arranged to at least partly enclose the first profile part and the first profile part is slidable into the second profile part for adjustment of a length of the profile from the first profile end to the profile handle end;

the housing is moveably attached to the profile arrangement, such that the housing is moveable along at least a part of the length of the profile arrangement; and wherein the profile arrangement comprises at least one elongated opening having a first opening section in the first profile part and a second opening section in the second profile part.

20. The vacuum cleaner according to claim 19, wherein the housing air inlet is positioned adjacent the elongated opening, and a portion of the elongated opening immediately adjacent the housing air inlet permits the airflow to pass therethrough from the profile arrangement to the housing air inlet.

21. The vacuum cleaner according to claim 20, further comprising a cover configured close off a portion of the elongated opening that is not immediately adjacent the housing air inlet.

22. The vacuum cleaner according to claim 21 wherein the cover comprises at least one of: a flexible cover strip, one or more elastic sealing elements, one or more lids; or a zipper arrangement.

23. A vacuum cleaner comprising;

a housing comprising a motor fan unit configured to generate an airflow, a housing air outlet and a housing air inlet;

a profile arrangement comprising a first profile end configured to attach to a nozzle, a profile handle end configured to attach to a handle and a profile extending between the first profile end and the profile handle end; and an airflow channel extending from the first profile end to the housing air outlet via the housing air inlet, configured to convey an airflow from the first profile end to the housing air outlet;

wherein:

the profile arrangement comprises a first profile part and a second profile part, the second profile part is arranged to at least partly enclose the first profile part and the first profile part is slidable into the second profile part for adjustment of a length of the profile from the first profile end to the profile handle end;

the housing is moveably attached to the profile arrangement, such that the housing is moveable along at least a part of the length of the profile arrangement; and the profile arrangement comprises two or more distinct openings along the length of the profile arrangement.

24. The vacuum cleaner according to claim 23 wherein the housing is attachable to the profile arrangement in two or more positions along the length of the profile arrangement at which the housing air inlet is in fluid communication with one distinct opening of the two or more distinct openings.

25. The vacuum cleaner according to claim 24, further comprising a cover, and wherein one or more distinct openings which is/are not in fluid communication with the air inlet is/are closed off by the cover.

* * * * *